US006986647B2

(12) United States Patent
Jones et al.

(10) Patent No.: US 6,986,647 B2
(45) Date of Patent: Jan. 17, 2006

(54) PUMP DESIGN FOR CIRCULATING SUPERCRITICAL CARBON DIOXIDE

(75) Inventors: William Dale Jones, Phoenix, AZ (US); Bryan J. Seegers, Phoenix, AZ (US); Hugh Gybbon Spilsbury, Scottsdale, AZ (US)

(73) Assignee: Tokyo Electron Limited, Tokyo (JP)

( * ) Notice: Subject to any disclaimer, the term of this patent is extended or adjusted under 35 U.S.C. 154(b) by 43 days.

(21) Appl. No.: 10/718,964

(22) Filed: Nov. 21, 2003

(65) Prior Publication Data

US 2005/0112003 A1 May 26, 2005

(51) Int. Cl.
*F04B 17/03* (2006.01)

(52) U.S. Cl. ..... 417/357; 417/366; 417/423.7; 310/87; 310/254; 310/261

(58) Field of Classification Search ..... 310/43, 310/86, 87, 90, 254, 261; 417/357, 366, 417/369, 370, 423.7
See application file for complete search history.

(56) References Cited

U.S. PATENT DOCUMENTS 2,993,449 A * 7/1961 Harland ..... 417/357
3,135,211 A * 6/1964 Pezzillo ..... 417/357
3,135,884 A * 6/1964 Luenberger ..... 310/87
3,135,885 A * 6/1964 Maynard ..... 310/87
5,356,272 A * 10/1994 Nagata et al. ..... 417/366
5,397,220 A * 3/1995 Akihisa et al. ..... 417/369
5,717,263 A * 2/1998 Cox ..... 310/261
5,779,445 A 7/1998 Yokota et al. ..... 415/230
6,262,510 B1 * 7/2001 Lungu ..... 310/254
6,447,270 B1 * 9/2002 Schmidt et al. ..... 417/366
6,847,140 B2 * 1/2005 Kimberlin et al. ..... 310/86

* cited by examiner

*Primary Examiner*—Michael Koczo, Jr.
(74) *Attorney, Agent, or Firm*—Haverstock & Owens LLP

(57) ABSTRACT

In accordance with an embodiment of the present invention, a pump assembly for circulating a supercritical fluid is disclosed. The pump assembly comprises an impeller for pumping fluid between a pump inlet and a pump outlet; a rotating pump shaft coupled to the impeller, wherein the pump shaft is supported by corrosion resistant bearings; a rotor of a DC motor potted in epoxy and encased in a non-magnetic material sleeve; and a stator sealed from the fluid via a polymer sleeve. The pump can be of centrifugal type. The bearings can be made of silicon nitride balls combined with bearing races made of Cronidur® and can operate without oil or grease lubrication. The polymer sleeve can be a PEEK™ sleeve which forms a casing for the stator. The non-magnetic material sleeve encasing the rotor of the DC motor is preferably made of stainless steel. A portion of the fluid passing through the pump assembly can be diverted over the bearings and/or the rotor and stator.

13 Claims, 1 Drawing Sheet

PUMP DESIGN FOR CIRCULATING SUPERCRITICAL CARBON DIOXIDE

FIELD OF THE INVENTION

This invention relates to an improved pump assembly design for circulating supercritical fluids. More particularly, the invention relates to an improved canned compact brushless DC pump assembly design provided with corrosive resistant bearings that operate without oil or grease lubrication, a stainless steel sealed rotor and a PEEK™ sealed stator, and that does not generate particles or contaminants.

BACKGROUND OF THE INVENTION

Traditional brushless canned motor pumps have a pump section and a motor section. The motor section drives the pump section. The pump section includes an impeller having blades which rotate inside a casing. The impeller pumps fluid from a pump inlet to a pump outlet. The impeller is normally of the closed type and is coupled to one end of a motor shaft that extends from the motor section into the pump section where it affixes to an end of the impeller.

The motor section includes an electric motor having a stator and a rotor. The rotor is unitarily formed with the motor shaft inside the stator. With brushless DC motors, the rotor is actuated by electromagnetic fields that are generated by current flowing through windings of the stator. A plurality of magnets are coupled to the rotor. During pump operation, the rotor shaft transmits torque, which is created by the generation of the electromagnetic fields with regard to the rotor's magnets, from the motor section to the pump section where the fluid is pumped.

Because the rotor and stator are immersed, they must be isolated to prevent corrosive attack and electrical failure. The rotor is submerged in the fluid being pumped and is therefore "canned" or sealed to isolate the motor parts from contact with the fluid. The stator is also "canned" or sealed to isolate it from the fluid being pumped. Mechanical contact bearings may be submerged in system fluid and are, therefore, continually lubricated. The bearings support the impeller and/or the motor shaft. A portion of the pumped fluid can be allowed to recirculate through the motor section to cool the motor parts and lubricate the bearings.

Seals and bearings are prone to failure due to continuous mechanical wear during operation of the pump. Mechanical rub between the stator and the rotor can generate particles. Interacting forces between the rotor and the stator in fluid seals and hydrodynamic behavior of journal bearings can lead to self-excited vibrations which may ultimately damage or even destroy rotating machinery. The bearings are also prone to failure. Lubricants can be rendered ineffective due to particulate contamination of the lubricant, which could adversely affect pump operation. Lubricants can also dissolve in the fluid being pumped and contaminate the fluid. Bearings operating in a contaminated lubricant exhibit a higher initial rate of wear than those not running in a contaminated lubricant. The bearings and the seals may be particularly susceptible to failure when in contact with certain chemistry. Alternatively, the bearings may damage the fluid being pumped.

What is needed is an improved brushless compact canned pump assembly design that substantially reduces particle generation and contamination, while rotating at high speeds and operating at supercritical temperatures and pressures.

SUMMARY OF THE INVENTION

In accordance with an embodiment of the present invention, a pump assembly for circulating a supercritical fluid is disclosed. The pump assembly comprises an impeller for pumping fluid between a pump inlet and a pump outlet; a rotating pump shaft coupled to the impeller, wherein the pump shaft is supported by corrosion resistant bearings; a rotor of a DC motor potted in epoxy and encased in a non-magnetic corrosion resistant material sleeve; and a stator sealed from the fluid via a polymer sleeve.

The pump assembly can further include an electrical controller suitable for operating the pump assembly. The electrical controller can include a commutation controller for sequentially energizing windings of the stator. The pump can be of centrifugal type. The bearings can operate without oil or grease lubrication. The bearings can be made of silicon nitride balls combined with bearing races made of Cronidur®. Cronidur® is a corrosion resistant metal alloy from Barden Bearings. The bearings can be ceramic bearings, hybrid bearings, full complement bearings, foil journal bearings, or magnetic bearings. The polymer sleeve can be a PEEK™ sleeve which forms a casing for the stator. The non-magnetic material sleeve encasing the rotor of the DC motor is preferably made of stainless steel. The non-magnetic material sleeve can be welded to the pump shaft such that torque is transferred through the non-magnetic material sleeve.

The impeller preferably has a diameter between 1 inch and 2 inch. The rotor preferably has a diameter between 1.5 inch and 2 inch. The rotor can have a maximum speed of 60,000 rpm. The pump assembly, which include a pump section and a motor section, can have an operating pressure in the range of 1,500 psi to 3,000 psi. The supercritical fluid preferably operates in the range of 40 to 100 degrees Celsius. The supercritical fluid can be supercritical carbon dioxide or supercritical carbon dioxide admixed with an additive or solvent. A portion of the supercritical fluid is diverted through the pump assembly and then back to the pump inlet through an outer flow path. The diverted supercritical fluid preferably passes through a filter and/or heat exchanger in the outer flow path before returning back to the pump inlet.

In an alternative embodiment of the present invention, a pump assembly for circulating a supercritical fluid is disclosed. The pump assembly includes an impeller for pumping fluid between a pump inlet and a pump outlet; a rotating pump shaft coupled to the impeller, wherein the pump shaft is supported by silicon nitride bearings; a rotor potted in epoxy and encased in a stainless steel sleeve, the stainless steel sleeve being welded to the pump shaft such that torque is transferred through the stainless steel sleeve; and a stator sealed from the fluid via a PEEK™ sleeve, the rotor and stator defining an alternative flow path to divert a portion of the supercritical fluid between the rotor and the stator, and then back to the pump inlet through an outer flow path.

DETAILED DESCRIPTION OF THE INVENTION

Figure 1:
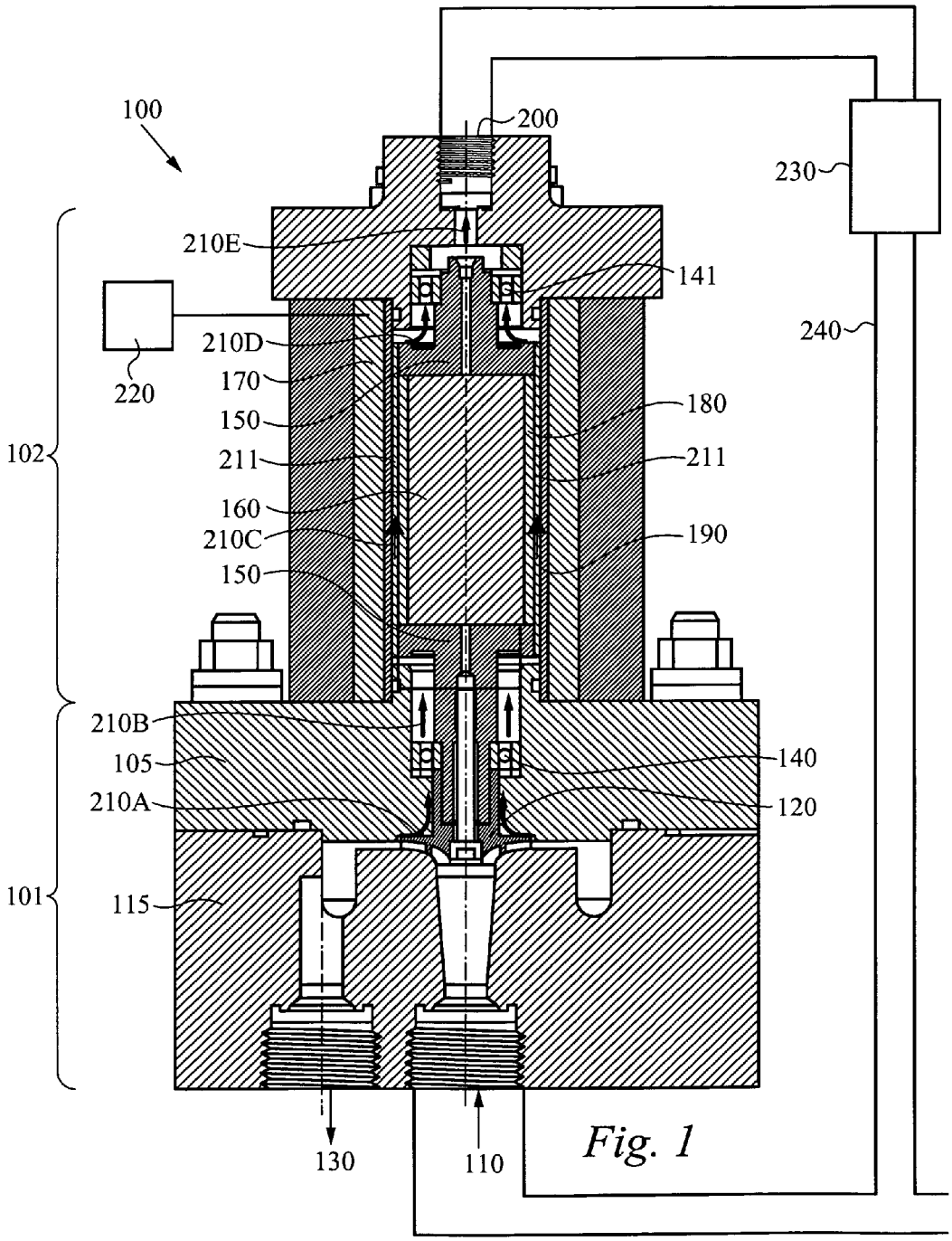
FIG. 1 is a cross-sectional view of a pump assembly showing a return path and filter assembly of a preferred embodiment according to the present invention.

A brushless compact canned pump assembly 100 is shown in FIG. 1 having a pump section 101 and a motor section 102. The motor section 102 drives the pump section 101. The pump section 101 incorporates a centrifugal impeller 120 rotating within the pump section 101, which includes an inner pump housing 105 and an outer pump housing 115. An inlet 110 delivers pump fluid to the impeller 120, and the impeller 120 pumps the fluid to an outlet 130.

The motor section 102 includes an electric motor having a stator 170 and a rotor 160. The electric motor can be a variable speed motor which allows for changing speed and/or load characteristics. Alternatively, the electric motor can be an induction motor. The rotor 160 is formed inside a non-magnetic stainless steel sleeve 180. The rotor 160 is canned to isolate it from contact with the fluid. The rotor 160 preferably has a diameter between 1.5 inches and 2 inches. The stator 170 is also canned to isolate it from the fluid being pumped. A pump shaft 150 extends away from the motor section 102 to the pump section 101 where it is affixed to an end of the impeller 120. The pump shaft 150 can be welded to the stainless steel sleeve 180 such that torque is transferred through the stainless steel sleeve 180. The impeller 120 preferably has a diameter between 1 inches and 2 inches and includes rotating blades. This compact design makes the pump assembly 100 more light weight which also increases rotation speed of the electric motor. The electric motor of the present invention can deliver more power from a smaller unit by rotating at higher speeds. The rotor 160 can have a maximum speed of 60,000 revolutions per minute (rpm). Of course other speeds and other impeller sizes will achieve different flow rates.

With brushless DC technology, the rotor 160 is actuated by electromagnetic fields that are generated by electric current flowing through windings of the stator 170. During operation, the pump shaft 150 transmits torque from the motor section 102 to the pump section 101 to pump the fluid. The motor section 102 can include an electrical controller 220 suitable for operating the pump assembly 100. The electrical controller 220 can include a commutation controller (not shown) for sequentially firing or energizing the windings of the stator 170.

The rotor 160 is potted in epoxy and encased in the stainless steel sleeve 180 to isolate the rotor 160 from the fluid. The stainless steel sleeve 180 creates a high pressure and substantially hermetic seal. The stainless steel sleeve 180 has a high resistance to corrosion and maintains high strength at very high temperatures which substantially eliminates the generation of particles. Chromium, nickel, titanium, and other elements can also be added to stainless steels in varying quantities to produce a range of stainless steel grades, each with different properties.

The stator 170 is also potted in epoxy and sealed from the fluid via a polymer sleeve 190. The polymer sleeve 190 is preferably a PEEK™ (Polyetheretherketone) sleeve. The PEEK™ sleeve forms a casing for the stator. Because the polymer sleeve 190 is an exceptionally strong highly crosslinked engineering thermoplastic, it resists chemical attack and permeation by $CO_2$ even at supercritical conditions and substantially eliminates the generation of particles. Further, the PEEK™ material has a low coefficient of friction and is inherently flame retardant. Other high-temperature and corrosion resistant materials, including alloys, can be used to seal the stator 170 from the fluid.

The pumping fluid employed in the present invention is preferably a supercritical fluid. The term "supercritical fluid" denotes fluids which are above both the critical temperature and critical pressure, and also includes both simple fluids and fluid mixtures. The supercritical fluid can be supercritical carbon dioxide ($CO_2$) or supercritical $CO_2$ admixed with other fluids, including additives and/or solvents. The supercritical fluid is of a nature and quantity to provide enhanced extraction of any particles contained in the pump assembly 100. The critical pressure of $CO_2$ is about 1,070 pounds per square inch (psi) and the critical temperature is about 31 degrees Celsius. An operating pressure of the pump assembly 100 is preferably in the range of 1,500 to 3,000 psi. The supercritical fluid preferably operates in the range 40 to 100 degrees Celsius. The supercritical fluid, in addition to providing enhanced particle extraction, can cool the motor section 102 of the pump assembly 100.

Besides eliminating the generation of particles, the pump assembly 100 of the present invention has other inventive features. The pump shaft 150 is supported by a first corrosion resistant bearing 140 and a second corrosion resistant bearing 141. The bearings 140 and 141 can be ceramic bearings, hybrid bearings, full complement bearings, foil journal bearings, or magnetic bearings. The bearings 140 and 141 can be made of silicon nitride balls combined with bearing races made of Cronidur®30. Cronidur®30 is a corrosion resistant metal alloy from Barden Bearings. Cronidur®30 is a martensitic through-hardened steel with mass percentage 0.31 mass percent carbon. 0.38 mass percent nitrogen. 0.55 mass percent Silicon, and 15.2 mass percent Chromium. The use of silicon nitride combined with bearing races made of Cronidur®produces bearings that can operate at high speeds and supercritical temperatures and pressure. These materials offer superb corrosion and wear resistance. The bearings 140 and 141 are non-lubricated in the sense that no oil or grease lubrication is required, although a portion of the fluid being pumped can be diverted to provide lubrication and cooling to the bearings. Thus, there can be no contamination of the fluid. The bearings 140 and 141 also reduce particle generation since wear particles generated by abrasive wear are not present in ceramic (silicon nitride) hybrids. The savings in reduced maintenance costs can be significant.

A portion of the pumped fluid is diverted and allowed to recirculate through the pump assembly 100 to lubricate the bearings 140 and 141, pick up any loose particles, and cool the motor section 102. $CO_2$ is, however, a poor lubricant. Thus, the diverted fluid is provided more for cooling the motor section 102 and the bearings 140 and 141 than for lubricating the bearings 140 and 141. As mentioned above, the bearings 140 and 141 are designed with materials that offer corrosion and wear resistance. The path of the diverted fluid defines the alternative low path. Starting at 210A, the fluid flows in the gap between the outer edge of impeller 120 and the inner pump housing 105, along the back face of the impeller 120, and along the impeller shaft to the bearing 140. Next the fluid flows through and cools the bearing 140. Following the path indicated by arrow 210B, the fluid flows along the pump shaft. The fluid then flows in the space defined between the rotor 160 and the stator 170 as shown by arrow 210C. After which, the fluid follows the path, as shown by arrow 210D, along the pump shaft 150 and through and cooling the bearing 141. The arrow 210E shows the exit path for the fluid at the outlet passage 200 in the motor section 102 and to an outer flow path 240. The fluid leaving the outlet passage 200 may have picked up particles generated in the motor section 102. The diverted fluid preferably passes through a filter and/or heat exchanger 230 in the outer flow path 240 before returning back to the pump inlet 110.

The present invention has been described in terms of specific embodiments incorporating details to facilitate the understanding of principles of construction and operation of the invention. Such reference herein to specific embodiments and details thereof is not intended to limit the scope of the claims appended hereto. It will be apparent to those skilled in the art that modification may be made in the embodiments chosen for illustration without departing from the spirit and scope of the invention.

What is claimed is:

1. A pump assembly for circulating a supercritical fluid, comprising: an impeller for pumping fluid between a pump inlet and a pump outlet; a rotating pump shaft coupled to the impeller, wherein the pump shaft is supported by non-lubricated bearings; a rotor of a DC motor potted in epoxy and encased in a stainless steel sleeve, the stainless steel sleeve being welded to the pump shaft such that torque is transferred through the stainless steel sleeve; and a stator sealed from the fluid via a Polyetheretherketone sleeve, the rotor and the stator defining an alternative flow path used to divert a portion of the supercritical fluid through the pump assembly and then back to the pump inlet through an outer flow path.

2. The pump assembly of claim 1, further including an electrical controller suitable for operating the pump assembly, wherein the electrical controller comprises a commutation controller for sequentially energizing windings of the stator.

3. The pump assembly of claim 1, wherein the pump is of centrifugal type.

4. The pump assembly of claim 1, wherein the impeller has a diameter between 1 inch and 2 inches.

5. The pump assembly of claim 1, wherein the rotor has a diameter between 1.5 inches and 2 inches.

6. The pump assembly of claim 1, wherein the rotor has a maximum speed of 60,000 rpm.

7. The pump assembly of claim 1, wherein an operating pressure of the pump assembly is in the range 1,500–3,000 psi.

8. The pump assembly of claim 1, wherein the supercritical fluid operates in the range 40–100 degrees Celsius.

9. The pump assembly of claim 1, wherein the supercritical fluid is supercritical carbon dioxide.

10. The pump assembly of claim 1, wherein the supercritical fluid is supercritical carbon dioxide admixed with an additive or solvent.

11. The pump assembly of claim 1, wherein the bearings are selected from the group consisting of ceramic bearings, hybrid bearings, full complement bearings, foil journal bearings and magnetic bearings.

12. The pump assembly of claim 1, wherein the motor is a variable speed motor.

13. The pump assembly of claim 1, wherein the motor is an induction motor.

* * * * *